US007082800B1

(12) United States Patent
Müller et al.

(10) Patent No.: US 7,082,800 B1
(45) Date of Patent: Aug. 1, 2006

(54) DEVICE FOR RAISING AND WITHDRAWING A BACK-UP ROLL BEARING UNIT

(75) Inventors: Karl-Friedrich Müller, Erndtebrück (DE); Volker Kunze, Siegen (DE)

(73) Assignee: SMS Demag AG, Düsseldorf (DE)

( * ) Notice: Subject to any disclaimer, the term of this patent is extended or adjusted under 35 U.S.C. 154(b) by 375 days.

(21) Appl. No.: 10/088,286

(22) PCT Filed: Sep. 16, 2000

(86) PCT No.: PCT/EP00/09058

§ 371 (c)(1),
(2), (4) Date: Jun. 21, 2002

(87) PCT Pub. No.: WO01/21333

PCT Pub. Date: Mar. 29, 2001

(30) Foreign Application Priority Data

Sep. 20, 1999 (DE) ..... 199 45 070

(51) Int. Cl.
*B21B 31/10* (2006.01)

(52) U.S. Cl. ..... 72/237; 29/260

(58) Field of Classification Search ..... 72/239; 29/252, 895, 896.1, 263, 282, 259, 260, 261
See application file for complete search history.

(56) References Cited

U.S. PATENT DOCUMENTS

| | | | | |
|---|---|---|---|---|
| 4,286,830 | A | 9/1981 | Salter, Jr. | |
| 4,352,229 | A | 10/1982 | Moore, Jr. | |
| 5,800,088 | A * | 9/1998 | Luckhof et al. | 403/349 |
| 6,415,489 | B1 * | 7/2002 | Martins et al. | 29/252 |

FOREIGN PATENT DOCUMENTS

| | | |
|---|---|---|
| DE | 195 03 682 C1 | 5/1996 |
| EP | 10723333 | 1/2001 |

* cited by examiner

*Primary Examiner*—Lowell A. Larson
(74) *Attorney, Agent, or Firm*—Friedrich Kueffner

(57) ABSTRACT

The invention relates to a device for raising and withdrawing a bearing unit of a back-up roll of a roll stand. Said bearing unit is comprised of a piece to be inserted inside which has a roll pin bearing arranged therein. According to the invention, a change-over device is configured so that it can be temporarily coupled to the bearing unit and is provided for effecting an axial movement toward and away from the back-up roll.

4 Claims, 3 Drawing Sheets

DEVICE FOR RAISING AND WITHDRAWING A BACK-UP ROLL BEARING UNIT

BACKGROUND OF THE INVENTION

1. Field of the Invention

Figure 1:
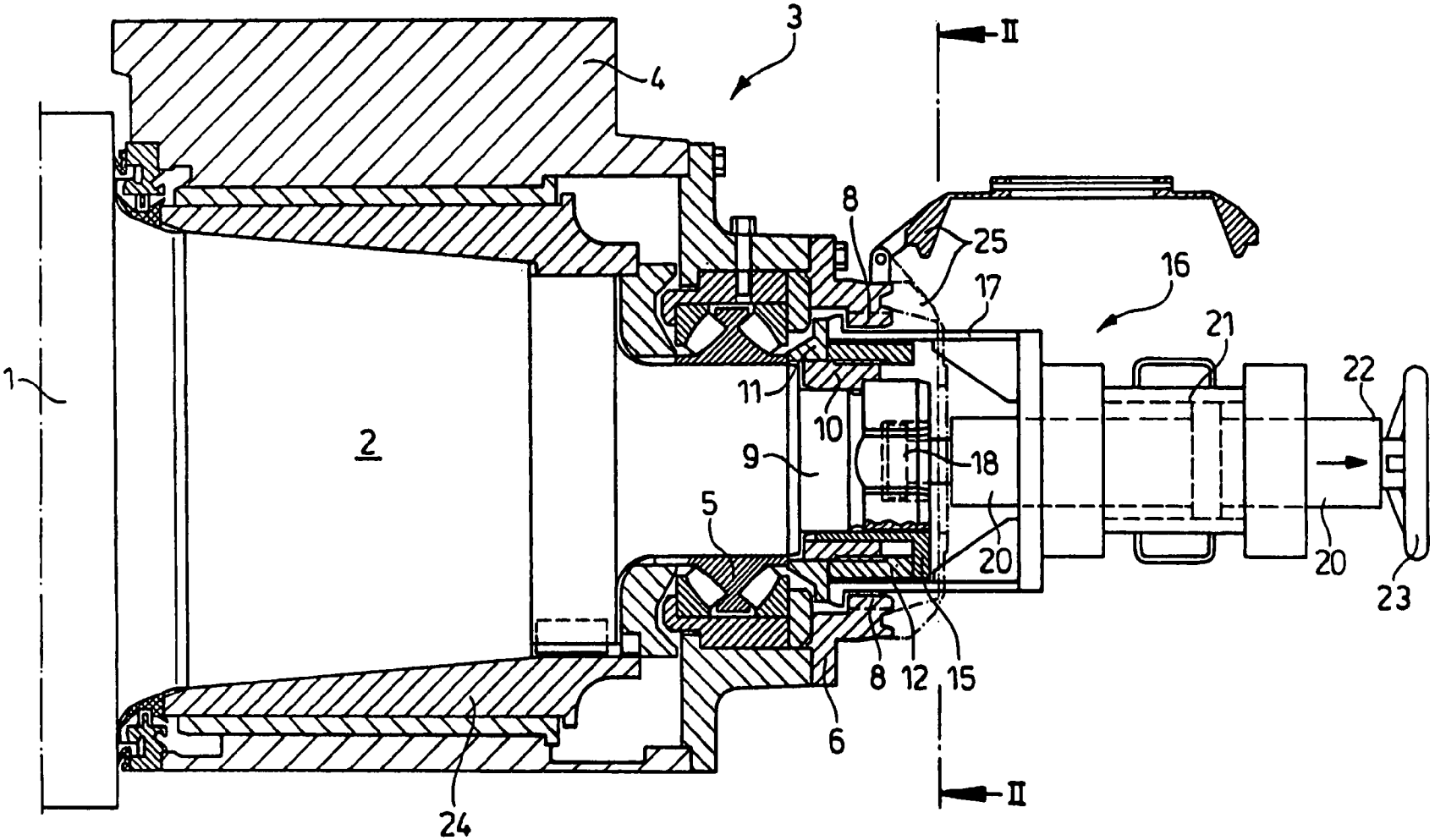

The invention relates to a device for mounting and demounting a bearing unit, comprised of a chock with a roll pin bearing arranged therein in connection with a back-up roll of a roll stand.

2. Description of the Related Art

It is known to arrange the back-up rolls of roll stands in such a bearing unit, for example, a Morgoil bearing. These have a hydraulic removal device installed within the chock for mounting and demounting the bearing onto and from the roll pin. Of these hydraulic removal devices, remaining at all times in each bearing unit, there must therefore be, for example, in a seven stand rolling train, a total of 28 such units because each back-up roll has on the movable as well as on the stationary bearing side a bearing unit, respectively. In addition to this, at least the same amount of space is required for additional change-over locations, and, moreover, a significant proportion of spare parts is required because they are cost-intensive specialty parts which have a long delivery time. As a result of the constant residence in the bearing unit, the hydraulic removal devices are also subject to external influences within the bearing, such as contaminated oil, bearing damage, and start-ups which reduce the service life and/or require repair work.

SUMMARY OF THE INVENTION

It is therefore an object of the present invention to provide a device with which the described disadvantages for back-up roll bearings can be avoided, which, in particular, reduces the expenditure of the bearing change, and which can be used variably.

This object is solved according to the invention by a change-over device which can be temporarily coupled to the bearing unit and is configured for generating an axial movement in the direction toward the back-up roll and away from it. By accordingly providing, on the one hand, a separate change-over device, i.e., a change-over device independent of the bearing unit, which, on the other hand, can be universally used for mounting as well as demounting the bearing unit, one change-over device is sufficient in order to mount or demount the bearing units; only when both bearing units of a back-up roll are to be changed at the same time, a second such change-over device is required. In no case, however, is it required any longer to provide each back-up roll of a roll stand with an integrated hydraulic removal device, as in the prior art. Aside from the fact that the change-over device is no longer exposed to the effects of the rolling operation, a simpler and lighter configuration results for the bearing units. The change-over device can advantageously be used in the bearing and roll shop, and it is only required to couple the device with the bearing unit to be demounted or newly installed in order to mount or demount with, if desired, a single change-over device all bearing units onto or from the respective back-up rolls.

According to one proposal of the invention, the change-over device has lever-like inner claws and lever-like outer claws, wherein the inner claws engage a pin end of the back-up rolls and the outer claws engage the bearing unit. The claws in this case provide the coupling means and serve at the same time for introducing the axial movement in order to push the bearing unit onto the roll pin or to remove it therefrom. Instead of a coupling via claws, the change-over device could also, for example, be coupled by a screw connection to the bearing unit.

In a further embodiment of the invention, the inner and outer claws are rotatable and can be locked like a bayonet closure in the pin end or in the bearing unit. After attaching or inserting the change-over device, the inner and outer claws must thus be rotated only by approximately 45° in order to ensure the locking action.

According to a preferred embodiment of the invention, the pin end and an intermediate ring, screwed externally onto the bearing unit, are cloverleaf-shaped, with through grooves for the inner and outer claws, and the claws have correlated therewith in situ, after rotation into an engagement position, complementary locking projections of the pin end or the intermediate ring, wherein, moreover, a pressure ring, connected in front of the roller pin bearing, is positioned opposite the outer claws. In this way, it can be achieved that the axial movement, introduced into the inner claws locked fixedly in the back-up roll, is deflected during removal into an oppositely oriented movement or force direction caused by the outer claws contacting the locking projections of the intermediate ring and, accordingly, removing the entire bearing unit from the roll pin. On the other hand, the claws press, as a result of the axial movement introduced into the inner claws being reversed also during mounting, onto the pressure ring so that the entire bearing unit is pushed onto the roll pin.

Even though the axial movement could be effected mechanically or by means of an electrical drive, for example, by means of a worm gear and a toothed rack, it is suggested advantageously that the inner claws are arranged on a piston of a hydraulic cylinder that can be integrated into the change-over device. Commercially available standard cylinders can be used for this purpose, and, as a result of the inventive separation of removal device and bearing unit, oil mixing between the lubricant oil and the hydraulic oil required for the axial and rolling pin bearings cannot occur.

When preferably the free piston end facing away from the inner claws of the hydraulic cylinder is provided with a handwheel, the bayonet closure can be reached simply from the exterior, and this is possible uniformly for the entire change-over device. This requires that the through grooves for the inner and outer claws as well as the claws themselves are aligned with one another.

BRIEF DESCRIPTION OF THE EMBODIMENTS

Figure 2:
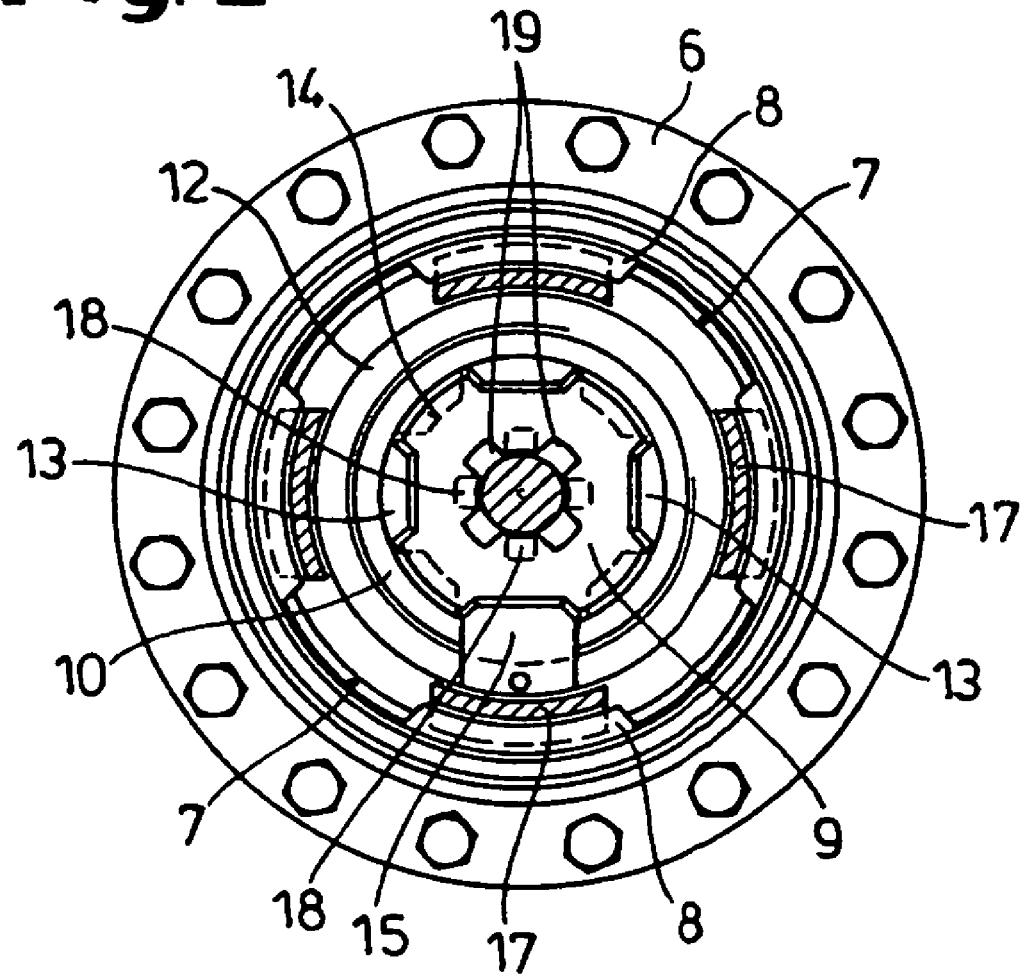

Further details and advantages of the invention result from the claims and the following description with the aid of one embodiment of the invention illustrated in the drawings. It is shown in:

FIG. 1 as a detail of a roll stand, not illustrated, the roll pin end of a back-up roll with bearing unit illustrated in longitudinal section during mounting by means of a change-over device;

FIG. 2 a section along the line II—II of FIG. 1; and

Figure 3:
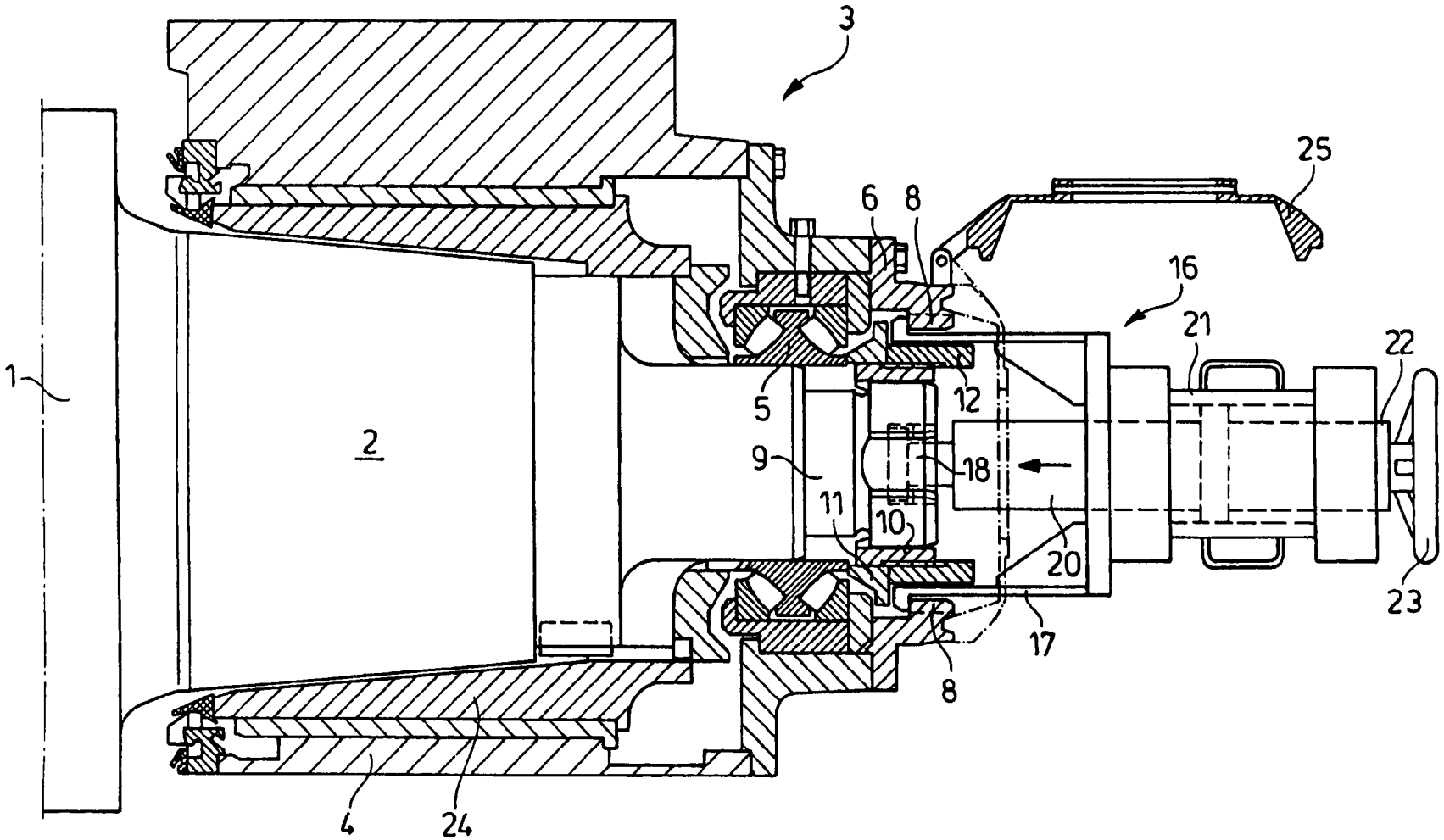

FIG. 3 the embodiment of FIG. 1 during the demounting process.

DETAILED DESCRIPTION OF THE EMBODIMENTS

The FIGS. 1 and 3 show only the roll pin 2 of a back-up roll 1, respectively. According to FIG. 1, a bearing unit 3 is mounted on the roll pin 2 which comprises a chock 4 with a roll pin bearing or axial bearing 5. An intermediate ring 6 is screwed onto the forward end of the bearing unit 3; the ring 6 has a shape like a cloverleaf and has alternatingly arranged through grooves 7 and locking projections 8 (compare FIG. 2).

On the roll pin 2, i.e., in the area of the roll pin end 9, a pressure ring 11 contacting the axial bearing 5 and a ring nut 12 threaded thereon are arranged on the locking ring 10. The locking ring 10 has also locking projections 13 which have correlated therewith through grooves 14, illustrated in dashed lines in FIG. 2, provided on the outer circumference of the roller pin end 9.

For mounting the bearing unit 3 in the operating position illustrated in FIG. 1, the bearing unit 3 is aligned and positioned exactly relative to the center of the back-up roll 1. The same holds true for the locking ring 10, whose locking projections 13 must to be aligned with the through grooves 14 of the roller pin end 9. Subsequently, the bearing unit 3 is carefully pushed onto the roll pin 2 and, by rotation of the locking ring 10, locked in the position illustrated in FIG. 2 on the back-up roll 1, i.e., its roll pin 2. The securing segment 15 subsequently mounted prevents then an unwanted rotation of the locking ring 10. For preparing the final mounting of the bearing unit 3, the ring nut 12 is screwed on as far as possible.

After completion of these preparatory measures, a change-over device 16 is attached which has four outer claws 17 positioned at identical spacing from one another and four inner claws 18 also spaced at an identical spacing from one another. The inner claws 18 are correlated with through grooves 19, illustrated in more detail in FIG. 2, in the roll pin end 9 at the end face. When inserting the change-over device 16, the outer claws 17 thus penetrate through the through grooves 9 of the intermediate ring 6 and the inner claws 18 through the through grooves 19, and, upon rotation by 45°, they reach their engagement position, illustrated in FIGS. 1 and 2, in which the outer claws 17 are locked on the intermediate ring 6, i.e., its locking projections 8, and the inner claws 19 are locked on the backup-roll 1, i.e., on its roll pin end 9. In the embodiment, the inner claws 18 are arranged on the cylinder piston 20 of a hydraulic cylinder 21 fastened on the change-over device 16 whose free cylinder piston end 22 is provided with a handwheel 23. During manipulation of the change-over device 16 with a swinging crane, not illustrated, the handwheel 23 provides in a simple way the possibility to perform the locking rotation of the claws.

When the hydraulic cylinder 21 is now loaded with pressure in the direction of the arrow illustrated in bold face, the change-over device 16, secured on the back-up roll 1 by means of the inner claws 18, presses via its outer claws 17 the pressure ring 11 against the roll pin bearing or axial bearing 5. In this way, the bearing unit 3 with its pin bushing 24 is pushed increasingly onto the cone of the roll pin 2 until it reaches the end position according to FIG. 1.

For securing this mounting position, the ring nut 12 is tightened to the dead stop. The claws 17, 18 are then aligned with the complementary through grooves 7 and 19 so that the change-over device 16 can be removed. When the holding segment 15 is secured by screwing on the ring nut 12, the ring nut is secured against detachment. As soon as the previously opened closure lid 25 has been pivoted into its closed position (illustrated in dash-dotted line in FIG. 1), in which it encapsulates the roll pin 2, the rolling operation can be started again.

The removal process illustrated in FIG. 3 is carried out in reverse, but otherwise identical, sequence of the afore described attachment of the change-over device 16—which is, however, preceded by the detachment of the holding segment 15 from the ring nut 12. By loading the cylinder piston 20 of the hydraulic cylinder 21 in the direction of the bold faced arrow, pressure is applied to the pressure ring 11 and the ring nut 12 is relieved which can then be removed so that the holding segment 15 (see FIG. 1) can be removed—which, for this reason, is not illustrated in FIG. 3. By rotation of the locking ring 10 by 45°, the bearing unit 3 is unlocked. After renewed application of hydraulic pressure, the change-over device 16, secured on the back-up roll 1 by means of the inner claws 18, pulls via the outer claws 17, which now contact the locking projections 8 of the intermediate ring 6, the intermediate ring 6 and thus the entire bearing unit 3 with the pin bushing 24 from the cone of the roll pin 2, as illustrated in FIG. 3. As soon as the pin bushing 24 is free, the hydraulic pressure can be switched off and the change-over device 16, as described in connection with mounting according to FIG. 1, can be removed. The bearing unit with the chock 4 and the axial bearing 5 is free in order to be removed carefully from the back-up roll 1.

The invention claimed is:

1. A device for mounting and demounting a bearing unit of a back-up roll of a roll stand, the bearing unit being comprised of a chock with a roll pin bearing arranged in the chock, the device comprising a change-over device comprising coupling means for temporarily coupling the change-over device with the bearing unit, wherein the change-over device has means for generating an axial movement in the direction toward the back-up roll for pushing the bearing unit onto the roll pin and away from the back-up roll for pushing the bearing unit from the roll pin, the coupling means of the change-over device comprising only two sets of claws that include lever-like inner claws and lever-like outer claws, wherein the inner claws engage a pin end of the back-up roll and the outer claws engage the bearing unit, wherein the inner and outer claws are rotatable and are lockable by bayonet closures in the pin end and in the bearing unit, respectfully, wherein the pin end and an intermediate ring connected to an outer side of the bearing unit are cloverleaf-shaped with through grooves for the inner and outer claws, wherein, after rotating the change-over device into an engagement position, complementary locking projections of the pin end and of the intermediate ring, respectively, are provided for the claws, and wherein a pressure ring connected in front of the roll pin bearing is positioned opposite the outer claws.

2. The device according to claim 1, wherein the change-over device comprises an integrated hydraulic cylinder with a piston, wherein the inner claws are arranged on the piston.

3. The device according to claim 2, wherein the piston has a free piston end facing away from the inner claws, further comprising a handwheel mounted on the free piston end.

4. A device for mounting and demounting a bearing unit of a back-up roll of a roll stand, the bearing unit being comprised of a chock with a roll pin bearing arranged in the chock, the device comprising a change-over device comprising coupling means for temporarily coupling the change-over device with the bearing unit, wherein the change-over device has means for generating and axial movement in the direction toward the back-up roll for pushing the bearing unit onto the roll pin and away from the back-up roll for pulling the bearing unit from the roll pin, the coupling means of the change-over device comprising only two sets of claws that include lever-like inner claws and lever-like outer claws, wherein the inner claws engage a pin end of the back-up roll and the outer claws engage the bearing unit, the pin end and an intermediate ring connected to an outer side of the bearing unit being cloverleaf-shaped with through grooves for the inner and outer claws, wherein, after rotating the change-over device into an engagement position, complementary locking projections of the pin end and of the intermediate ring, respectively, are provided for the claws, and wherein a pressure ring connected in front of the roll pin bearing is positioned opposite the outer claws.

* * * * *